US011352825B2

(12) United States Patent
Stack et al.

(10) Patent No.: US 11,352,825 B2
(45) Date of Patent: Jun. 7, 2022

(54) PORT-DOOR RELEASE ASSEMBLY AND A DOOR ASSEMBLY THAT UTILIZES THE PORT-DOOR RELEASE ASSEMBLY

(71) Applicant: GM GLOBAL TECHNOLOGY OPERATIONS LLC, Detroit, MI (US)

(72) Inventors: Matthew M. Stack, Macomb Township, MI (US); Omair Mustafa, Windsor (CA); Dayananda Narasimhaiah, Franklin, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 9 days.

(21) Appl. No.: 17/030,478

(22) Filed: Sep. 24, 2020

(65) Prior Publication Data

US 2022/0090433 A1 Mar. 24, 2022

(51) Int. Cl.
*E05F 15/00* (2015.01)
*E05F 15/63* (2015.01)

(52) U.S. Cl.
CPC ..... *E05F 15/63* (2015.01); *E05Y 2201/11* (2013.01); *E05Y 2201/41* (2013.01); *E05Y 2201/422* (2013.01); *E05Y 2201/624* (2013.01); *E05Y 2201/686* (2013.01); *E05Y 2201/706* (2013.01); *E05Y 2201/71* (2013.01); *E05Y 2800/11* (2013.01); *E05Y 2800/296* (2013.01); *E05Y 2900/534* (2013.01)

(58) Field of Classification Search
CPC ... E05Y 2900/534; E05B 81/08; E05B 81/16; E05B 83/34; E05B 63/22; B60K 2015/0584; B60K 2015/0569; B60K 2015/0561; B60K 2015/0538; B60K 2015/053; B60K 15/05; B60K 15/04
USPC ..... 49/348, 324, 340, 341; 296/97.22
See application file for complete search history.

(56) References Cited

U.S. PATENT DOCUMENTS

| | | | | |
|---|---|---|---|---|
| 6,588,270 | B1 * | 7/2003 | Petzold | B60K 15/04 340/617 |
| 8,684,443 | B2 * | 4/2014 | Hara | B60R 13/04 296/97.22 |
| 8,845,001 | B2 * | 9/2014 | Kotama | B60K 1/04 296/97.22 |
| 9,038,499 | B2 * | 5/2015 | Ishiguro | E05C 19/022 74/550 |
| 9,493,967 | B2 * | 11/2016 | Basavarajappa | E05B 83/34 |
| 10,384,534 | B2 * | 8/2019 | Guardianelli | E05B 83/34 |

(Continued)

*Primary Examiner* — Chi Q Nguyen
(74) *Attorney, Agent, or Firm* — Quinn IP Law

(57) ABSTRACT

A port-door release assembly includes a door and a linkage coupled to the door to support the door during movement between open and closed positions. The port-door release assembly includes a drive shaft coupled to the linkage to drive movement of the linkage. The port-door release assembly includes a motor configured to rotate the drive shaft which moves the linkage and the door to the open and/or closed positions. The port-door release assembly includes a back-up release assembly movable relative to the linkage to disconnect the drive shaft from the linkage which allows the door to move to the open position without actuation of the motor. A door assembly includes the port-door release assembly as described above and a housing defining a port in which the door is movable relative to the housing between the open position that uncovers the port and the closed position that covers the port.

20 Claims, 4 Drawing Sheets

(56) References Cited

U.S. PATENT DOCUMENTS

| | | | | |
|---|---|---|---|---|
| 11,072,252 | B2 * | 7/2021 | Winkler | B60Q 1/2661 |
| 11,098,506 | B2 * | 8/2021 | Schwab | E05B 81/06 |
| 11,117,464 | B2 * | 9/2021 | Glickman | E05F 15/616 |
| 2012/0047807 | A1 * | 3/2012 | Lee | E05B 81/25 49/349 |
| 2013/0326955 | A1 * | 12/2013 | Kotama | B60L 58/12 49/13 |
| 2016/0108648 | A1 * | 4/2016 | Nam | E05B 17/0037 292/142 |
| 2016/0375761 | A1 * | 12/2016 | Horikawa | E05F 15/622 49/276 |

* cited by examiner

PORT-DOOR RELEASE ASSEMBLY AND A DOOR ASSEMBLY THAT UTILIZES THE PORT-DOOR RELEASE ASSEMBLY

INTRODUCTION

A vehicle may include a body panel and a door coupled to the body panel. The door may be accessible from outside of the vehicle to recharge or refuel the vehicle. Additionally, the door may be movable relative to an outer surface of the body panel to access a port in order to recharge or refuel the vehicle. The door may be equipped with a door mechanism that operates to open and close the door under normal operation. The door may also be equipped with a separate override mechanism that operates independently of the door mechanism to open the door when the door mechanism is interrupted. Generally, the separate override mechanism is completely spaced from the door mechanism, and thus, additional space and components are necessary for the override mechanism.

SUMMARY

The present disclosure provides a port-door release assembly that includes a door movable between an open position and a closed position. The port-door release assembly also includes a linkage coupled to the door to support the door during movement between the open position and the closed position. The port-door release assembly further includes a drive shaft rotatable about a longitudinal axis. The drive shaft is coupled to the linkage to drive movement of the linkage. The port-door release assembly also includes a motor coupled to the drive shaft. The motor is configured to rotate the drive shaft which moves the linkage and the door to the open position and/or the closed position. In addition, the port-door release assembly includes a back-up release assembly coupled to the linkage and the drive shaft. The back-up release assembly is movable relative to the linkage to disconnect the drive shaft from the linkage which allows the door to move to the open position without actuation of the motor.

In one aspect, the back-up release assembly is movable relative to the linkage between an extended position in which the back-up release assembly engages the linkage to connect the drive shaft to the linkage, and a retracted position in which the back-up release assembly disengages the linkage to disconnect the drive shaft from the linkage which allows the door to move to the open position without actuation of the motor.

Furthermore, in certain aspects, the back-up release assembly includes a sleeve attached to the drive shaft. The sleeve engages the linkage when in the extended position and disengages from the linkage when in the retracted position. The sleeve is attached to the drive shaft such that the sleeve and the drive shaft concurrently rotate about the longitudinal axis.

In another aspect, the sleeve is movable along the longitudinal axis independently of the drive shaft between the extended position in which the sleeve engages the linkage to connect the drive shaft to the linkage and the retracted position in which the sleeve disengages from the linkage to disconnect the drive shaft from the linkage which allows the door to move to the open position without actuation of the motor.

In one aspect, the drive shaft defines a cavity disposed along the longitudinal axis. In certain configurations, the sleeve is movable to the retracted position in which the sleeve moves into the cavity away from the linkage to disconnect the drive shaft from the linkage which allows the door to move to the open position without actuation of the motor. That is, the sleeve is movable into the cavity when the sleeve moves to the retracted position to retract the sleeve away from the linkage.

In yet another aspect, the back-up release assembly includes a pull rod disposed through the drive shaft and the sleeve. In certain configurations, the pull rod is disposed through the cavity such that the pull rod is exposed outside of the drive shaft. The pull rod is movable along the longitudinal axis to disengage the sleeve from the linkage when in the retracted position. In certain configurations, the pull rod is configured to move axially along the longitudinal axis which causes the sleeve to move axially along the longitudinal axis independently of the drive shaft. Therefore, for example, the pull rod is movable along the longitudinal axis which causes the sleeve to move axially along the longitudinal axis independently of the drive shaft to disengage the sleeve from the linkage when in the retracted position.

In one aspect, the drive shaft includes a shoulder, and the back-up release assembly includes a biasing member that continuously biases the sleeve into the flange toward the extended position. In certain configurations, the biasing member is disposed inside the cavity between the sleeve and the shoulder such that the biasing member continuously biases the sleeve to the extended position.

In another aspect, the sleeve and the linkage each include a key that cooperate with each other when in the extended position to transfer rotational movement between the drive shaft and the linkage. In certain configurations, the linkage defines a depression extending away from the drive shaft, and the key of the linkage is disposed inside of the depression. The sleeve includes an outer surface that surrounds the longitudinal axis, and the key of the sleeve is disposed along the outer surface.

According to further aspects, the pull rod includes a flange and an actuator grip separated via the drive shaft. Generally, the sleeve abuts the flange. The pull rod is movable axially along the longitudinal axis in response to movement of the actuator grip which causes the sleeve to move due to the flange.

In one aspect, the motor includes a cover defining an aperture along the longitudinal axis. The pull rod is disposed through the aperture such that the motor separates the actuator grip from the flange.

In another aspect, the motor includes a gear having a plurality of teeth. The cavity is spaced from the teeth of the drive shaft. The drive shaft has a plurality of teeth that mesh with the teeth of the gear of the motor such that actuation of the motor transfers torque to the drive shaft to rotate the drive shaft.

According to further aspects, the linkage includes a first arm and a second arm spaced from the first arm. The linkage includes a connector disposed between and connected to the first and second arms. The connector of the linkage is secured to the door. The back-up release assembly engages the first arm or the second arm when in the extended position to connect the drive shaft to the linkage. In certain configurations, the sleeve and the first arm of the linkage each include the key that cooperate with each other when in the extended position to transfer rotational movement between the drive shaft and the linkage.

The present disclosure also provides a door assembly that includes a housing defining a port. The door assembly includes the port-door release assembly as described above, and is coupled to the housing. The door is movable relative to the housing between the open position that uncovers the port and the closed position that covers the port.

In one aspect, the housing includes a first side that faces the door and a second side that opposes the first side. The housing defines a plurality of slots spaced from each other, and the port is disposed between the slots.

In another aspect, the linkage includes a first arm disposed through one of the slots and a second arm disposed through another one of the slots. The back-up release assembly engages the first arm or the second arm when in an extended position to connect the drive shaft to the linkage.

In yet another aspect, the sleeve engages the first arm when in the extended position and disengages from the first arm when in a retracted position to disconnect the drive shaft from the linkage which allows the door to move to the open position without actuation of the motor.

The detailed description and the drawings or FIGS. are supportive and descriptive of the disclosure, but the claim scope of the disclosure is defined solely by the claims. While some of the best modes and other configurations for carrying out the claims have been described in detail, various alternative designs and configurations exist for practicing the disclosure defined in the appended claims.

DETAILED DESCRIPTION

Those having ordinary skill in the art will recognize that all directional references (e.g., above, below, upward, up, downward, down, top, bottom, left, right, vertical, horizontal, etc.) are used descriptively for the FIGS. to aid the reader's understanding, and do not represent limitations (for example, to the position, orientation, or use, etc.) on the scope of the disclosure, as defined by the appended claims. Furthermore, the term "substantially" can refer to a slight imprecision or slight variance of a condition, quantity, value, or dimension, etc., some of which that are within manufacturing variance or tolerance ranges.

Figure 1:
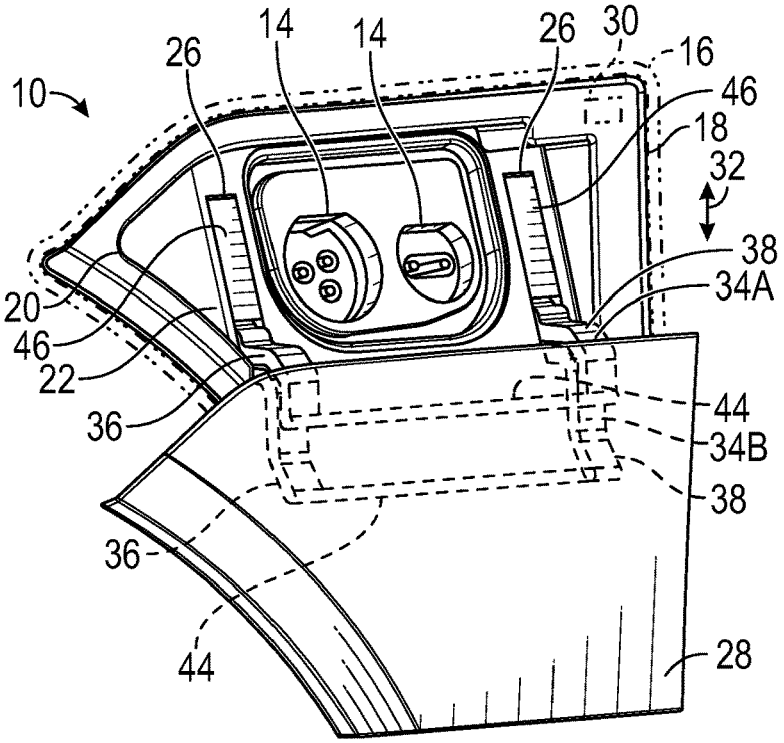
FIG. 1 is a schematic perspective front view of a door assembly, with a door in an open position.
Figure 2:
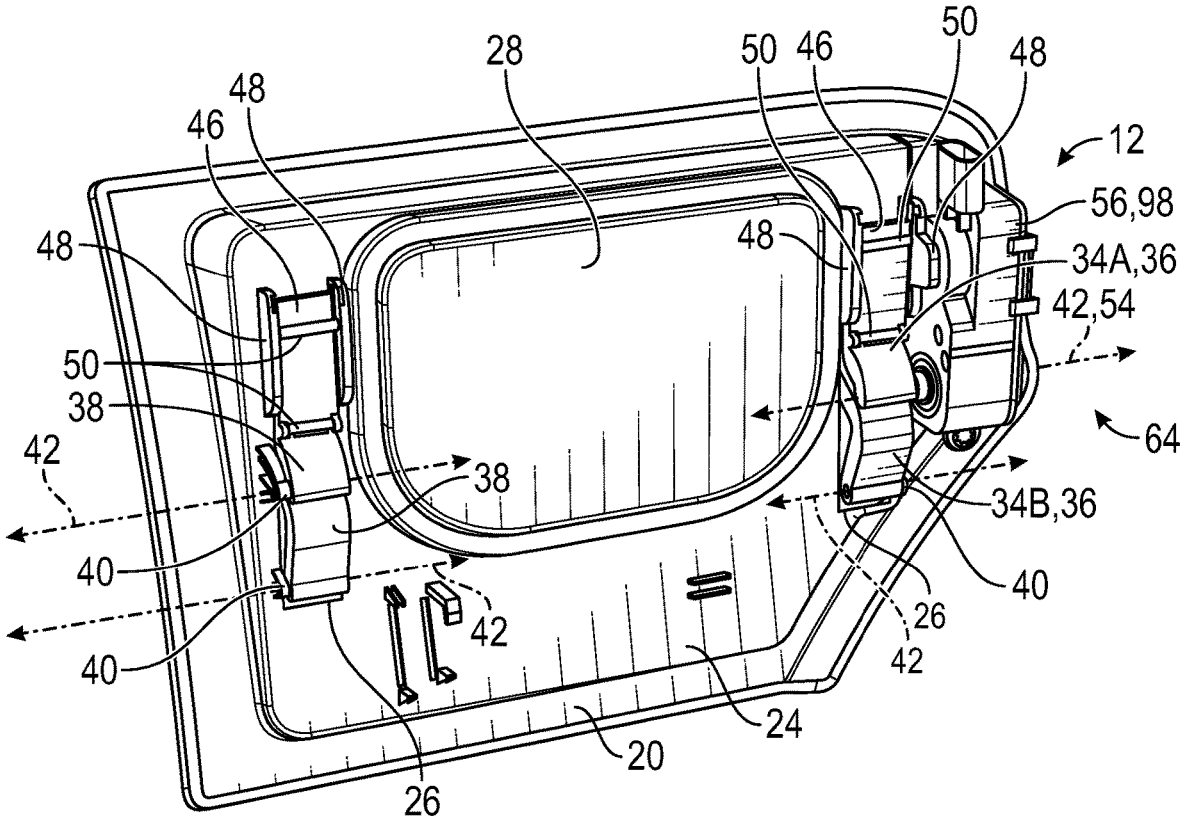
FIG. 2 is a schematic perspective back view of the door assembly with a port removed, and with the door in a closed position.

Referring to the FIGS., wherein like numerals indicate like or corresponding parts throughout the several views, a door assembly 10 and a port-door release assembly 12 are generally shown in FIGS. 1 and 2, which may be used with a port 14 that is accessible outside or external to a structure. The door assembly 10 and the port-door release assembly 12 are configured to allow access to the port 14 during certain situations, which will be discussed further below.

For example, the port 14 may be accessible from outside of a movable platform, such as a vehicle. The port 14 may provide a location to charge or re-fuel the movable platform. Non-limiting examples of the movable platform, such as the vehicle, may include a car, a truck, a motorcycle, an off-road vehicle, a farm vehicle, a watercraft, an aircraft, or any other suitable moveable platform. Additionally, the vehicle may be a diesel/gas-powered vehicle, a hybrid vehicle, an electric vehicle, etc. It is to be appreciated that alternatively, the door assembly 10 and the port-door release assembly 12 may be used in non-vehicle applications, which may include farm equipment, stationary platforms, building equipment, structures, buildings, robots, movable or stationary power plants, etc.

When the vehicle is a hybrid vehicle or an electric vehicle, the vehicle may include one or more batteries that may be recharged. The hybrid or electric vehicle may be recharged by providing an external power source to recharge the batteries. For example, the power source may be electricity that is delivered to the batteries by various electrical components. Therefore, the vehicle may be plugged in through the port 14 to recharge the batteries. This type of vehicle may be referred to as a plug-in hybrid vehicle or a plug-in electric vehicle.

When the vehicle is a hybrid vehicle, diesel/gas-powered vehicle, or any other fuel-powered (regardless of whether using a liquid fluid or a gas fluid) vehicle, the vehicle may include a tank that holds fuel. In this type of vehicle, fuel may be delivered to the tank through the port 14.

Referring to FIG. 1, the vehicle may include one or more body panels 16 that provide an outer appearance to the vehicle. For illustrative purposes, FIG. 1 illustrates part of one body panel 16 in phantom lines (dash-dot-dot-dash lines). One or more of the body panels 16 may provide an access point 18 to the port 14. Therefore, the door assembly 10 is coupled to the body panels 16 at the access point 18.

The door assembly 10 includes a housing 20 defining the port 14. The housing 20 is fixed to one or more of the body panels 16 at the access point 18. Therefore, the port-door release assembly 12 is coupled to the housing 20. It is to be appreciated that one or more ports 14 may be defined via the housing 20, as shown in FIG. 1. For illustrative purposes, the housing 20 illustrates two ports 14.

Generally, the housing 20 includes a first side 22 (see FIG. 1) and a second side 24 (see FIG. 2) that opposes the first side 22. The first side 22 may face outwardly toward the outside of the movable platform. In certain configurations, the housing 20 may define a plurality of slots 26 spaced from each other, and the port 14 is disposed between the slots 26.

Continuing with FIGS. 1 and 2, the port-door release assembly 12 includes a door 28, and the first side 22 of the housing 20 may face the door 28. The door 28 is movable between an open position (see FIG. 1) and a closed position (see FIG. 2). More specifically, the door 28 is movable relative to the housing 20 between the open position that uncovers the port 14 and the closed position that covers the port 14. That is, when the door 28 is in the closed position, the port 14 is not visible from outside of the vehicle, and thus, is not accessible from outside of the vehicle. When the door 28 is in the open position, the door 28 uncovers the port 14, and thus, the port 14 is accessible from outside of the vehicle. The door 28 may create a flush appearance with the body panel(s) 16 when in the closed position to provide an aesthetic outer appearance.

It is to be appreciated that the housing 20 may include an activator 30 (shown in phantom lines in FIG. 1) that is activated to move the door 28 between the open and closed positions. For example, when the door 28 is in the closed position, the door 28 may be slightly pushed inwardly toward the first side 22 of the housing 20 which causes the door 28 to engage the activator 30, which activation then causes the door 28 to move to the open position. From the open position, the activator 30 is visible to a user, so the activator 30 may be engaged via the user, which activation then causes the door 28 to move to the closed position. Alternatively, the user may lift the door 28 back to the closed position. The activator 30 may be any suitable configuration, and non-limiting examples may include a button, a sensor, etc.

Generally, the door 28 translates axially in the direction of a vertical arrow 32. For example, when referring to the orientation of the door 28 as shown in FIG. 1, the door 28 moves up and down vertically relative to the vertical arrow 32. It is to be appreciated that the direction that the door 28 translates depends on the orientation of the door 28, and the figures are non-limiting examples.

Figure 3:
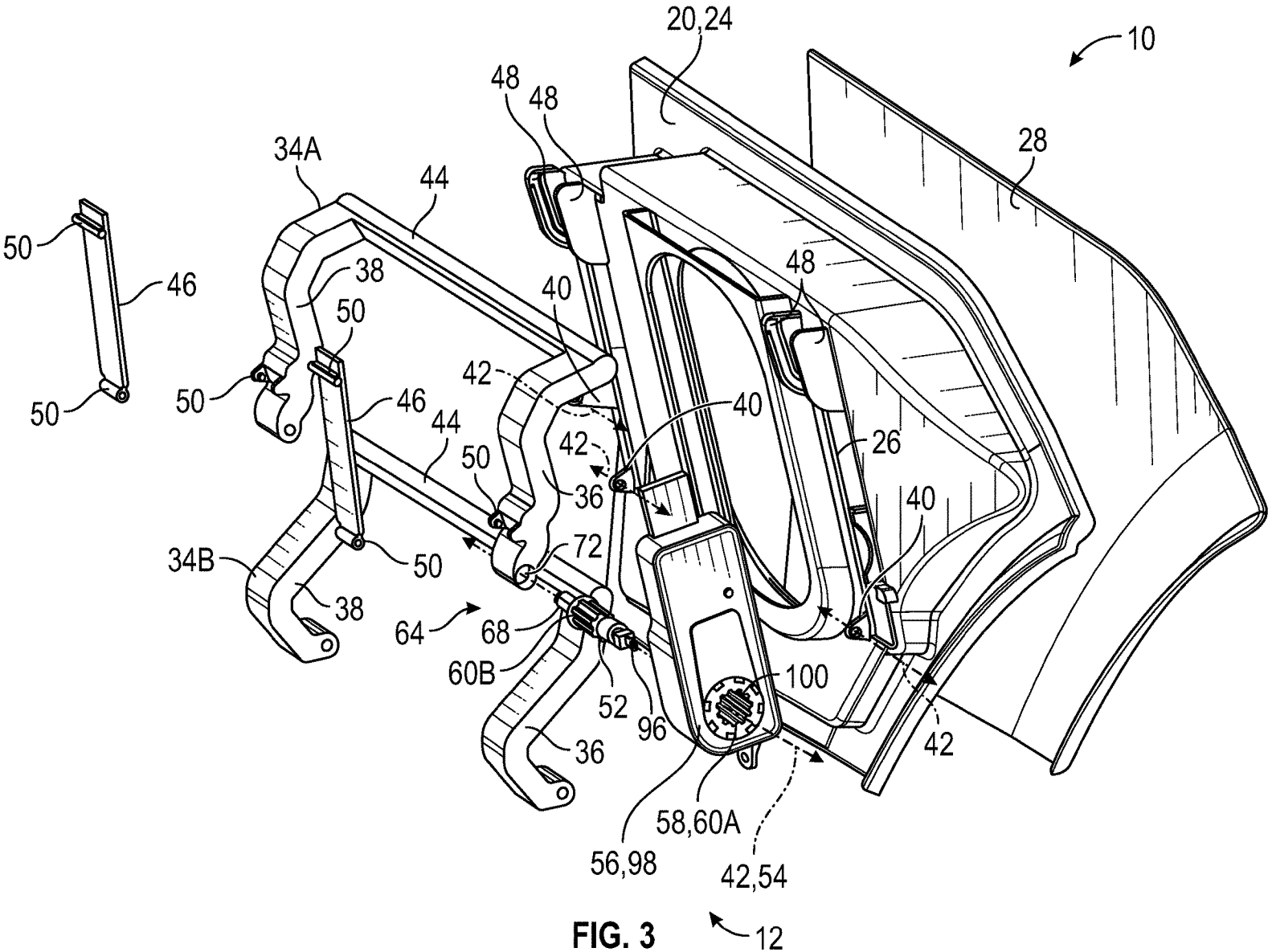
FIG. 3 is a schematic perspective partial-exploded view of a port-door release assembly.

Referring to FIGS. 1-3, the port-door release assembly 12 also includes a linkage 34A (will be referred to as the first linkage 34A for the discussion herein) coupled to the door 28 to support the door 28 during movement between the open position and the closed position. The first linkage 34A may include a first arm 36 and a second arm 38 spaced from the first arm 36. The first arm 36 may be disposed through one of the slots 26 of the housing 20 and the second arm 38 may be disposed through another one of the slots 26 of the housing 20. In certain configurations, the first arm 36 and the second arm 38 are secured to the door 28.

Generally, the first linkage 34A is rotatable relative to the housing 20 which causes translation of the door 28 in the direction of the vertical arrow 32. Therefore, the first linkage 34A may be attached to the second side 24 of the housing 20 at a pivot point 40. As such, the first linkage 34A is rotatable at the pivot point 40 about a linkage axis 42. The linkage axis 42 is transverse to the vertical axis. The first linkage 34A may cause the door 28 to move outwardly away from first side 22 of the housing 20 as the door 28 moves between the open and closed positions. For example, if the door 28 is slightly recessed inside the housing 20 to create the flush appearance with the body panel(s) 16 when in the closed position, then as the first linkage 34A rotates, the door 28 may move outwardly from the housing 20 as the door 28 translates.

Furthermore, the first linkage 34A may include a connector 44 disposed between and connected to the first and second arms 36, 38. The connector 44 links together the first and second arms 36, 38 such that movement of one of the arms 36, 38 causes movement of the other one of the arms 36, 38. In certain configurations, the connector 44 of the first linkage 34A is secured to the door 28. The connector 44 may be elongated to assist in stabilizing the door 28.

As shown in FIGS. 1-3, more than one linkage 34A, 34B may be coupled to the door 28 to support the door 28, i.e., the first linkage 34A, a second linkage 34B, and so on. Each of the first and second linkages 34A, 34B may be configured having a respective one of the first arm 36, the second arm 38, and the connector 44. The first and second linkages 34A, 34B may be referred to as a 4-bar linkage hinge.

Each of the first and second linkages 34A, 34B may be disposed through the corresponding slots 26 as best shown in FIGS. 1 and 2. Furthermore, each of the first and second linkages 34A, 34B are rotatable about a corresponding pivot point 40, and thus, are rotatable about a corresponding linkage axis 42. Generally, as best shown in FIG. 2, the linkage axis 42 of the first linkage 34A is substantially parallel to the linkage axis 42 of the second linkage 34B.

Due to the way that the first and second linkages 34A, 34B connect to the door 28, the first and second linkages 34A, 34B move concurrently or synchronized about the pivot point 40 of the respective first and second linkages 34A, 34B. As such, for example, if the first linkage 34A drives rotation, then the second linkage 34B is driven by the first linkage 34A. Part of the first and second linkages 34A, 34B may be disposed outside of the housing 20 relative to the first side 22 when the door 28 is in the open position (see FIG. 1).

Referring to FIGS. 2 and 3, a closeout 46 is coupled to one of the first and second linkages 34A, 34B. For example, the closeout 46 may be coupled to the first linkage 34A and the housing 20, and the closeout 46 moves in response to movement of the first linkage 34A to close the slot 26 when the door 28 is in the open position (see FIG. 1). When the door 28 is in the closed position (see FIG. 2), the closeout 46 is disposed behind part of the first linkage 34A relative to the outside of the body panels 16.

Continuing with FIGS. 2 and 3, the housing 20 may include a track 48 that the closeout 46 moves along to guide the closeout 46 back and forth as the door opens and closes. Generally, the track 48 extends outwardly from the second side 24 of the housing 20. In the orientation of FIG. 2, to move to the open position, the first linkage 34A rotates about the pivot point 40, the closeout 46 ramps downwardly and forward while the connector 44 moves outwardly away from the first side 22, and the door 28 translates to the open position. Once the door 28 is completely open, the closeout 46 aligns in the slot 26 to prevent components behind the housing 20 from being visible. It is to be appreciated that the second linkage 34B also moves in response to the first linkage 34A driving the second linkage 34B.

Continuing with FIGS. 2 and 3, the closeout 46 may be coupled to the first linkage 34A and the track 48 at respective connection points 50 along the first arm 36 and/or the second arm 38. One of the connection points 50 of the closeout 46 is disposed in the track 48 and moves along the track 48, and this connection therebetween may allow the closeout 46 to rotate relative to the track 48. Another one of the connection points 50 may allow the closeout 46 to rotate relative to the first linkage 34A so that the connection between the closeout 46 and the first linkage 34A does not bind. In certain configurations, a plurality of closeouts 46 may be used, i.e., one of the closeouts 46 coupled to the first arm 36 and another one of the closeouts 46 coupled to the second arm 38. As such, the closeouts 46 close a corresponding one of the slots 26 when the door 28 is in the open position. Furthermore, a plurality of tracks 48 may be used if using the plurality of closeouts 46, and each of the closeouts 46 may include respective connection points 50. Generally, the connection points 50 are spaced from each other along the respective closeouts 46, as best shown in FIG. 3. In certain configurations, the connection points 50 are spaced from the pivot point 40.

Figure 4:
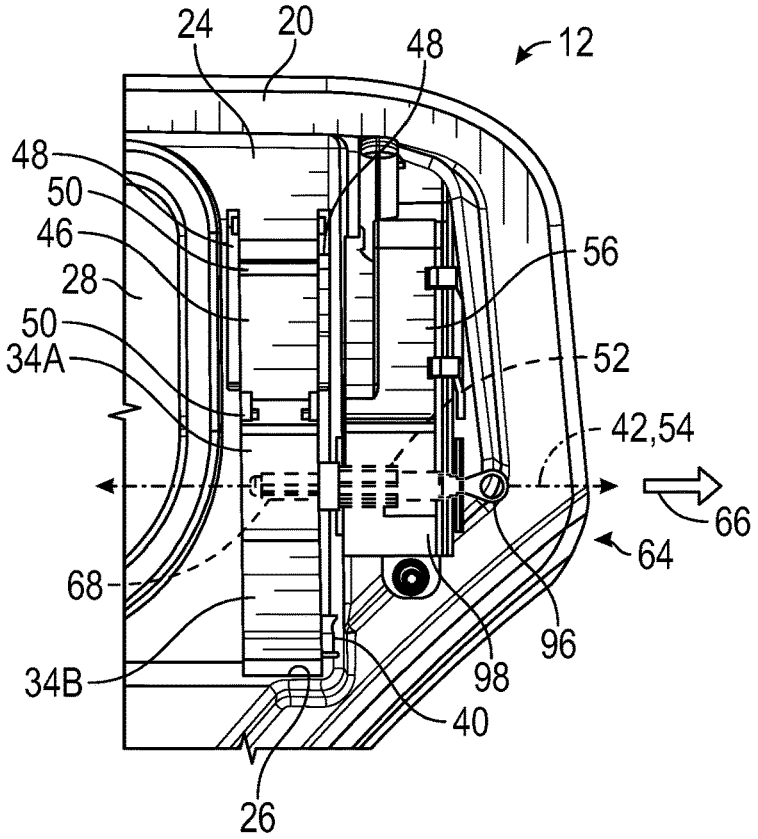
FIG. 4 is a schematic fragmentary back view of the port-door release assembly of FIG. 2.

Referring to FIGS. 3 and 4, the port-door release assembly 12 includes a drive shaft 52 rotatable about a longitudinal axis 54. Furthermore, the port-door release assembly 12 includes a motor 56 coupled to the drive shaft 52. Generally, the drive shaft 52 and the motor 56 remain connected to each other. Furthermore, the motor 56 is in electrical communication with the activator 30. Therefore, during normal operation, in response to activation of the activator 30, the motor 56 operates to ultimately move the door 28 between the open and closed positions.

Figure 7:
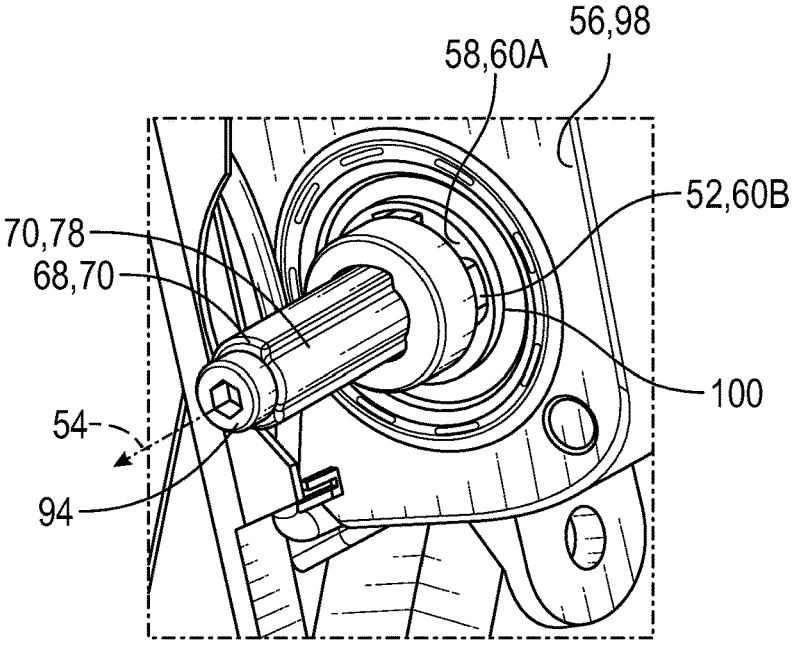
FIG. 7 is a schematic fragmentary perspective view of the drive shaft engaging a gear of a motor, and a sleeve protruding outwardly from the drive shaft.

In certain configurations, the motor 56 may include a gear 58 having a plurality of teeth 60A (as best shown in FIG. 7). The gear 58 cooperates with the drive shaft 52, and thus, actuation of the motor 56 causes rotation of the gear 58 which transfers torque to the drive shaft 52. In certain configurations, the drive shaft 52 has a plurality of teeth 60B (as best shown in FIG. 7) that mesh with the teeth 60A of the gear 58 of the motor 56 such that actuation of the motor 56 transfers torque to the drive shaft 52 to rotate the drive shaft 52. For example, the drive shaft 52 may include an outer surface 62 that surrounds the longitudinal axis 54, and the teeth 60B of the drive shaft 52 may be disposed along the outer surface 62.

The drive shaft 52 is coupled to the first linkage 34A to drive movement of the first linkage 34A, and the drive shaft 52 is spaced from the second linkage 34B. Therefore, movement of the first linkage 34A via the drive shaft 52 then causes the first linkage 34A to drive the second linkage 34B. More specifically, actuation of the motor 56 transfers torque to the drive shaft 52 to turn the drive shaft 52. That is, the motor 56 is configured to rotate the drive shaft 52 which moves the first linkage 34A and the door 28 to the open position and/or the closed position. As such, when the motor 56 operates to turn the drive shaft 52 in a first direction about the longitudinal axis 54, the door 28 moves to the open position, and when the motor 56 operates to turn the drive shaft 52 in a second direction opposite the first direction, the door 28 moves to the closed position.

A controller may control actuation of the motor 56 in the first and second directions to achieve the desired position of the door 28, i.e., the open and closed positions. More specifically, the controller may be in communication with the activator 30, and activation of the activator 30 signals the controller to operate the motor 56.

In a situation where an interruption of the motor 56 occurs and/or an interruption of the controller occurs and/or an interruption of the activator 30 occurs, it is desirable to implement a back-up or override system to operate the door 28. For example, if there is a power interruption, an activation interruption, and/or a mechanical issue with one or more components/structures, then the door 28 may not be able to move between the open and closed positions. As such, if the motor 56 and/or the activator 30 does not operate and/or the controller is not functioning, while the door 28 is in the closed position, the back-up or override system may be used to move the door 28 to the open position without using the motor 56, the activator 30, and/or the controller. Therefore, the port-door release assembly 12 includes a back-up release assembly 64 (as best shown in FIG. 4) that is configured to allow operation of the door 28 when the interruption occurs.

Generally, the back-up release assembly 64 is coupled to the first linkage 34A and the drive shaft 52. The back-up release assembly 64 is movable relative to the first linkage 34A to disconnect the drive shaft 52 from the first linkage 34A which allows the door 28 to move to the open position without actuation of the motor 56. The back-up release assembly 64 provides a compact structure that uses minimal space and maximizes the available packaging space. The back-up release assembly 64 is scalable and easily tuned for optimal performance. As such, costs may be saved using the back-up release assembly 64.

One way to implement the back-up release assembly 64 is to disengage the first linkage 34A from the drive shaft 52. As such, the back-up release assembly 64 is movable relative to the first linkage 34A between an extended position (see FIGS. 2, 4, and 5) in which the back-up release assembly 64 engages the first linkage 34A to connect the drive shaft 52 to the first linkage 34A, and a retracted position (see FIG. 6) in which the back-up release assembly 64 disengages the first linkage 34A to disconnect the drive shaft 52 from the first linkage 34A which allows the door 28 to move to the open position without actuation of the motor 56. Arrow 66 in FIG. 4 illustrates the direction that the back-up release assembly 64 moves to disengage the first linkage 34A in the retracted position. In certain configurations, the back-up release assembly 64 engages the first arm 36 or the second arm 38 when in the extended position to connect the drive shaft 52 to the first linkage 34A.

Figure 5:
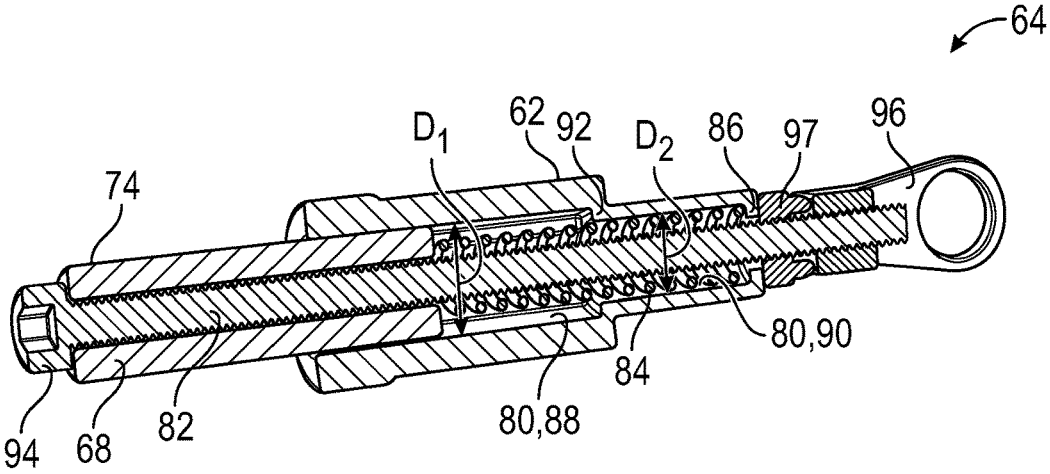
FIG. 5 is a schematic perspective view of a drive shaft and a back-up release assembly in an extended position.
Figure 6:
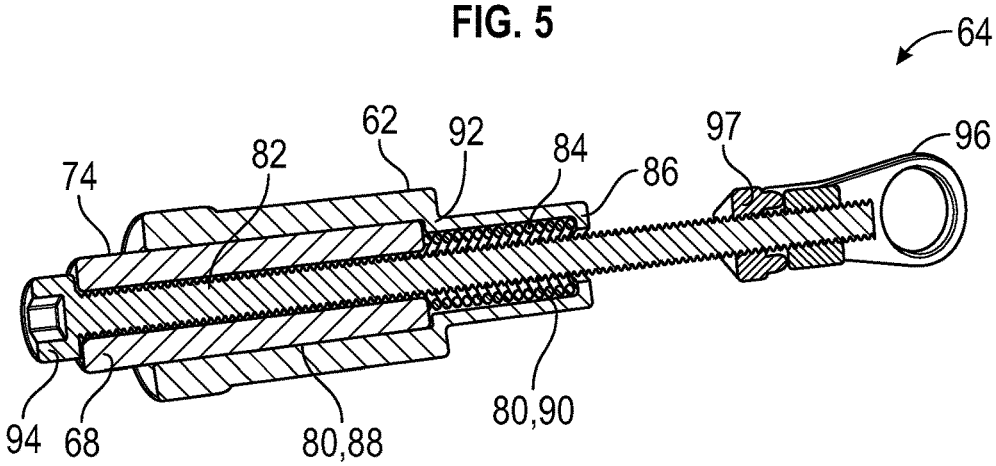
FIG. 6 is a schematic perspective view of the drive shaft and the back-up release assembly in a retracted position.

As best shown in FIGS. 5-7, the back-up release assembly 64 may include a sleeve 68 attached to the drive shaft 52. The sleeve 68 engages the first linkage 34A when in the extended position and disengages from the first linkage 34A when in the retracted position. Furthermore, the sleeve 68 is attached to the drive shaft 52 such that the sleeve 68 and the drive shaft 52 concurrently rotate about the longitudinal axis 54. That is, the sleeve 68 and the drive shaft 52 are always rotatably connected, i.e. regardless of whether the sleeve 68 is in the extended position or the retracted position. Rotation of the sleeve 68 causes rotation of the first and second linkages 34A, 34B about the respective linkage axes 42 when in the extended position. In certain configurations, the linkage axis 34 of the first linkage 34A is coaxial or aligns with the longitudinal axis 54.

The sleeve 68 is also movable along the longitudinal axis 54 independently of the drive shaft 52 between the extended position in which the sleeve 68 engages the first linkage 34A to connect the drive shaft 52 to the first linkage 34A and the retracted position in which the sleeve 68 disengages from the first linkage 34A to disconnect the drive shaft 52 from the first linkage 34A which allows the door 28 to move to the open position without actuation of the motor 56. That is, the drive shaft 52 remains axially stationary relative to the longitudinal axis 54, and the sleeve 68 is movable back and forth axially relative to the longitudinal axis 54. As such, the sleeve 68 is both rotatable about the longitudinal axis 54 and movable axially along the longitudinal axis 54, but the drive shaft 52 is not movable axially along the longitudinal axis 54.

The sleeve 68 and the first linkage 34A may be connected in any suitable configuration to transfer rotational movement therebetween while also allowing the sleeve 68 to disconnect from the first linkage 34A. For example, referring to FIGS. 7 and 8, the sleeve 68 and the first linkage 34A each may include a key 70 that cooperate with each other when in the extended position to transfer rotational movement between the drive shaft 52 and the first linkage 34A. In certain configurations, the first arm 36 of the first linkage 34A may include the key 70. The key 70 of the sleeve 68 and the key 70 of the first linkage 34A may be any suitable configuration, and the FIGS. are for illustrative purposes.

The key 70 of the sleeve 68 and the key 70 of the first linkage 34A are configured to engage each other in a single predetermined orientation so that the door 28 may be reconnected to the motor 56 in the proper orientation after implementing the back-up release assembly 64. Therefore, the key 70 of the sleeve 68 and the key 70 of the first linkage 34A cooperate to provide self-aligning features to return the components/structures back to the normal operating conditions in which the motor 56 may return to controlling movement of the door 28.

For example, in certain configurations, the first linkage 34A may define a depression 72 extending away from the drive shaft 52, and the key 70 of the first linkage 34A is disposed inside of the depression 72. In certain configurations, the depression 72 is defined by the first arm 36 or the second arm 38. In one configuration, the key 70 is disposed inside the depression 72 of the first arm 36 of the first linkage 34A.

Figure 8:
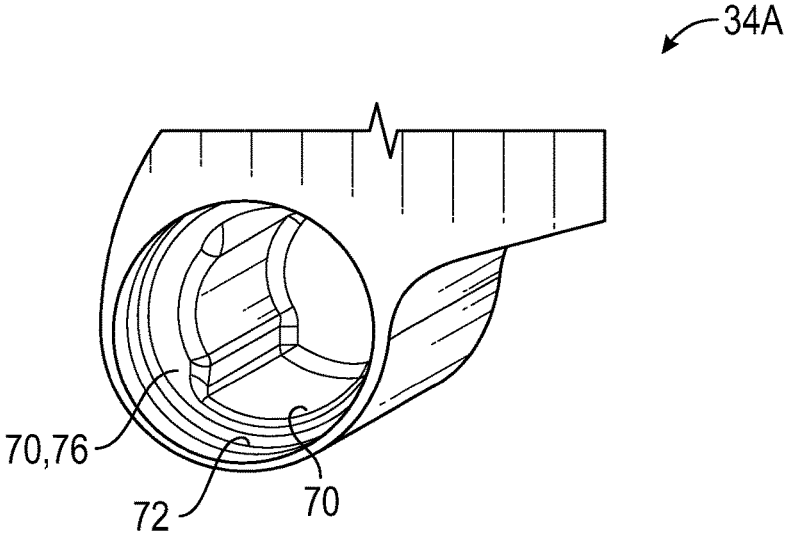
FIG. 8 is a schematic fragmentary perspective view of a key of a linkage.

As another example, the sleeve 68 may include an outer surface 74 that surrounds the longitudinal axis 54, and the key 70 of the sleeve 68 may be disposed along the outer surface 74 of the sleeve 68. The key 70 of sleeve 68 and the key 70 of the first linkage 34A may be complementary to each other, as best shown in FIGS. 7 and 8. For example, a first part 76 of the key 70 of the first linkage 34A protrudes outwardly into the depression 72, and a second part 78 of the key 70 of the sleeve 68 recesses inwardly to receive the first part 76 of the key 70 of the first linkage 34A which locks the first linkage 34A and the sleeve 68 together in the predetermined orientation to transfer rotational movement therebetween.

Generally, the sleeve 68 is partially disposed inside of the depression 72 of the first linkage 34A to operationally connect the drive shaft 52 to the first linkage 34A. In certain configurations, the depression 72 is disposed along the longitudinal axis 54. Thus, the key 70 of the sleeve 68 is movable along the longitudinal axis 54 into the depression 72 from the retracted position to the extended position when the keys 70 align.

Turning to FIGS. 5 and 6, in certain configurations, generally, the drive shaft 52 at least partially surrounds the sleeve 68. The drive shaft 52 may define a cavity 80 disposed along the longitudinal axis 54, and the sleeve 68 may be movable into the cavity 80 when the sleeve 68 moves to the retracted position to retract the sleeve 68 away from the first linkage 34A. The sleeve 68 is movable along the longitudinal axis 54 independently of the drive shaft 52 to the retracted position in which the sleeve 68 moves into the cavity 80 away from the first linkage 34A to disconnect the drive shaft 52 from the first linkage 34A which allows the door 28 to move to the open position without actuation of the motor 56. In certain configurations, the sleeve 68 engages the first arm 36 when in the extended position and disengages from the first arm 36 when in the retracted position to disconnect the drive shaft 52 from the first linkage 34A which allows the door 28 to move to the open position without actuation of the motor 56.

Referring to FIGS. 3, 5, and 6, the cavity 80 is spaced from the teeth 60B of the drive shaft 52. Furthermore, the outer surface 62 of the drive shaft 52 surrounds the cavity 80. That is, the teeth 60B of the drive shaft 52 at least partially surrounds the cavity 80.

As best shown in FIGS. 5 and 6, the back-up release assembly 64 may include a pull rod 82 disposed through the drive shaft 52 and the sleeve 68. Therefore, in certain configurations, the pull rod 82 is disposed through the cavity 80 (of the drive shaft 52) such that the pull rod 82 is exposed outside of the drive shaft 52. The pull rod 82 is movable along the longitudinal axis 54 to disengage the sleeve 68 from the first linkage 34A when in the retracted position. More specifically, the pull rod 82 is configured to move axially along the longitudinal axis 54 which causes the sleeve 68 to move axially along the longitudinal axis 54 independently of the drive shaft 52. That is, the pull rod 82 is movable along the longitudinal axis 54 which causes the sleeve 68 to move axially along the longitudinal axis 54 independently of the drive shaft 52 to disengage the sleeve 68 from the first linkage 34A when in the retracted position. By aligning the pull rod 82 and the sleeve 68 along the longitudinal axis 54, a compact design may be achieved, which saves space.

The back-up release assembly 64 may include a biasing member 84 that continuously biases the sleeve 68 toward the extended position. The biasing member 84 also provides a biasing force sufficient to rotatably couple the drive shaft 52 and the sleeve 68 together to transfer torque to the first linkage 34A to move the door between the open and closed positions during normal operation. The biasing member 84 may be any suitable configuration, and one non-limiting example is a spring, such as a coil spring.

The drive shaft 52 may include one or more features to retain the biasing member 84. For example, the drive shaft 52 may include a shoulder 86, and the biasing member 84 may react against the shoulder 86 to continuously bias the sleeve 68 toward the extended position. In certain configurations, the biasing member 84 is disposed inside the cavity 80 between the sleeve 68 and the shoulder 86 such that the biasing member 84 continuously biases the sleeve 68 to the extended position.

In addition, the cavity 80 may include a first portion 88 having a first diameter $D_1$ and a second portion 90 having a second diameter $D_2$ less than the first diameter $D_1$ to present a step 92 between the first and second portions 88, 90. The sleeve 68 may be movable into the first portion 88, and the biasing member 84 may be at least partially disposed in the second portion 90. The step 92 provides a stop for axial movement of the sleeve 68 in the retracted position. Therefore, as shown in FIG. 6, the sleeve 68 may abut the step 92 when in the retracted position which causes the biasing member 84 to be completely retained inside the second portion 90. The second portion 90 may act as a collar for the biasing member 84 to assist in maintaining the position of the biasing member 84 relative to the sleeve 68. The biasing member 84 may be partially disposed inside of the first portion 88 when the sleeve 68 is in the extended position.

As best shown in FIGS. 4-6, the pull rod 82 may include a flange 94 and an actuator grip 96 separated via the drive shaft 52. Generally, when a force is applied to the actuator grip 96 in the direction of arrow 66 in FIG. 4, the pull rod 82 and the corresponding sleeve 68 move axially along the longitudinal axis 54 to the retracted position. The actuator grip 96 may be any suitable configuration, and one non-limiting example is a pull ring.

The sleeve 68 may abut the flange 94, which prevents the sleeve 68 from disconnecting from the pull rod 82. The biasing member 84 continuously biases the sleeve 68 into the flange 94 toward the extended position. As such, the flange 94 and the sleeve 68 remain in contact continuously. The pull rod 82 is movable axially along the longitudinal axis 54 in response to movement of the actuator grip 96 which causes the sleeve 68 to move due to the flange 94.

The pull rod 82 may be threaded, and a nut 97 may be threaded to the pull rod 82 to limit the distance that the sleeve 68 moves axially to the extended position. Furthermore, the nut 97 may abut the shoulder 86 when the sleeve 68 is in the extended position. As such, the shoulder 86 may act as a stop that the nut 97 engages when in the extended position. The actuator grip 96 may be fixed to the nut 97.

Turning to FIGS. 3, 4, and 7, the motor 56 may include a cover 98 defining an aperture 100 along the longitudinal axis 54. The gear 58 of the motor 56 is disposed inside the cover 98. More specifically, the teeth 60A of the gear 58 face outwardly into the aperture 100. The drive shaft 52 is disposed inside the aperture 100 such that the teeth 60B of the drive shaft 52 mesh with the teeth 60A of the gear 58. The pull rod 82 is disposed through the aperture 100 such that the motor 56 separates the actuator grip 96 from the flange 94. In other words, the actuator grip 96 is exposed outside of the cover 98 along one side of the motor 56, and the flange 94 is exposed outside of the cover 98 along another side of the motor 56. The pull rod 82 is movable through the aperture 100 of the motor 56 to move the sleeve between the extended and retracted positions.

A cord may be connected to the actuator grip 96 to actuate the back-up release assembly 64 in order to bypass the motor 56. The cord may be hidden from sight but accessible via the user when needed to bypass operation of the motor 56. For example, the cord may be accessible from a wheel liner, under a hood, behind another door or another panel, etc. Regardless of the configuration of the cord, etc., to actuate the actuator grip 96, the cord will be generally disposed along the same side as the actuator grip 96 in order to cause the axial movement along the longitudinal axis 54.

Once the cord is accessed and pulled, the pull rod 82 causes the sleeve 68 to move axially along the longitudinal axis 54 to the retracted position which disconnects the sleeve 68 from the first linkage 34A, and which in turn, disconnects the drive shaft 52 and the motor 56 from the first linkage 34A. Therefore, the motor 56 is bypassed in this situation. When the sleeve 68 has been disconnected from the first linkage 34A, the door 28 may automatically swing open due to gravity or the door 28 may be manually touched to swing the door 28 open.

When it is desired to reconnect the drive shaft 52 and the motor 56 to the door 28, the door 28 is lifted back to the closed position, and the key 70 of the sleeve 68 and the key 70 of the first linkage 34A are realigned in the predetermined orientation complementary to each other such that the sleeve 68 may return to the extended position, and thus, the drive shaft 52 is reconnected to the first linkage 34A through the sleeve 68, which resets the motion of the door 28 between the open and closed positions.

While the best modes and other configurations for carrying out the disclosure have been described in detail, those familiar with the art to which this disclosure relates will recognize various alternative designs and configurations for practicing the disclosure within the scope of the appended claims. Furthermore, the configurations shown in the drawings or the characteristics of various configurations mentioned in the present description are not necessarily to be understood as configurations independent of each other. Rather, it is possible that each of the characteristics described in one of the examples of a configuration can be combined with one or a plurality of other desired characteristics from other configurations, resulting in other configurations not described in words or by reference to the drawings. Accordingly, such other configurations fall within the framework of the scope of the appended claims.

What is claimed is:

1. A port-door release assembly comprising:

a door movable between an open position and a closed position;

a linkage coupled to the door to support the door during movement between the open position and the closed position;

a drive shaft rotatable about a longitudinal axis and coupled to the linkage to drive movement of the linkage;

a motor coupled to the drive shaft and configured to rotate the drive shaft to move the linkage and the door to the open position and/or the closed position; and a back-up release assembly coupled to the linkage and the drive shaft, and the back-up release assembly is movable relative to the linkage to disconnect the drive shaft from the linkage to allow the door to move to the open position without actuation of the motor.

2. The port-door release assembly as set forth in claim 1 wherein the back-up release assembly is movable relative to the linkage between an extended position such that the back-up release assembly engages the linkage to connect the drive shaft to the linkage, and a retracted position such that the back-up release assembly disengages the linkage to disconnect the drive shaft from the linkage to allow the door to move to the open position without actuation of the motor.

3. The port-door release assembly as set forth in claim 2 wherein the back-up release assembly includes a sleeve attached to the drive shaft, and the sleeve engages the linkage when in the extended position and disengages from the linkage when in the retracted position.

4. The port-door release assembly as set forth in claim 3 wherein:

the back-up release assembly includes a pull rod disposed through the drive shaft and the sleeve; and the pull rod is movable along the longitudinal axis to disengage the sleeve from the linkage when in the retracted position.

5. The port-door release assembly as set forth in claim 4 wherein:

the drive shaft defines a cavity disposed along the longitudinal axis;

the pull rod is disposed through the cavity such that the pull rod is exposed outside of the drive shaft; and the sleeve is movable into the cavity when the sleeve moves to the retracted position to retract the sleeve away from the linkage.

6. The port-door release assembly as set forth in claim 5 wherein:

the drive shaft includes a shoulder; and the back-up release assembly includes a biasing member disposed inside the cavity between the sleeve and the shoulder such that the biasing member continuously biases the sleeve to the extended position.

7. The port-door release assembly as set forth in claim 1 wherein:

the back-up release assembly includes a sleeve attached to the drive shaft such that the sleeve and the drive shaft concurrently rotate about the longitudinal axis; and the sleeve is movable along the longitudinal axis independently of the drive shaft between an extended position such that the sleeve engages the linkage to connect the drive shaft to the linkage and a retracted position such that the sleeve disengages from the linkage to disconnect the drive shaft from the linkage to allow the door to move to the open position without actuation of the motor.

8. The port-door release assembly as set forth in claim 7 wherein the sleeve and the linkage each include a key that cooperate with each other when in the extended position to transfer rotational movement between the drive shaft and the linkage.

9. The port-door release assembly as set forth in claim 8 wherein:

the linkage defines a depression extending away from the drive shaft, and the key of the linkage is disposed inside of the depression; and the sleeve includes an outer surface that surrounds the longitudinal axis, and the key of the sleeve is disposed along the outer surface.

10. The port-door release assembly as set forth in claim 9 wherein the back-up release assembly includes a pull rod disposed through the drive shaft and the sleeve; and the pull rod is configured to move axially along the longitudinal axis to cause the sleeve to move axially along the longitudinal axis independently of the drive shaft.

11. The port-door release assembly as set forth in claim 10 wherein:

the pull rod includes a flange and an actuator grip separated via the drive shaft;

the sleeve abuts the flange; and the pull rod is movable axially along the longitudinal axis in response to movement of the actuator grip to cause the sleeve to move due to the flange.

12. The port-door release assembly as set forth in claim 11 wherein the back-up release assembly includes a biasing member that continuously biases the sleeve into the flange toward the extended position.

13. The port-door release assembly as set forth in claim 11 wherein the motor includes a cover defining an aperture along the longitudinal axis, and the pull rod is disposed through the aperture such that the motor separates the actuator grip from the flange.

14. The port-door release assembly as set forth in claim 1 wherein:

the motor includes a gear having a plurality of teeth; and the drive shaft has a plurality of teeth that mesh with the teeth of the gear of the motor such that actuation of the motor transfers torque to the drive shaft to rotate the drive shaft.

15. The port-door release assembly as set forth in claim 14 wherein:

the drive shaft defines a cavity disposed along the longitudinal axis and the cavity is spaced from the teeth of the drive shaft;

the back-up release assembly includes a sleeve attached to the drive shaft such that the sleeve and the drive shaft concurrently rotate about the longitudinal axis; and the sleeve is movable along the longitudinal axis independently of the drive shaft between an extended position such that the sleeve engages the linkage to connect the drive shaft to the linkage and a retracted position such that the sleeve moves into the cavity away from the linkage to disconnect the drive shaft from the linkage to allow the door to move to the open position without actuation of the motor.

16. A port-door release assembly comprising:

a door movable between an open position and a closed position;

a linkage coupled to the door to support the door during movement between the open position and the closed position;

a drive shaft rotatable about a longitudinal axis and coupled to the linkage to drive movement of the linkage;

a motor coupled to the drive shaft and configured to rotate the drive shaft to move the linkage and the door to the open position and/or the closed position;

a back-up release assembly coupled to the linkage and the drive shaft, and the back-up release assembly is movable relative to the linkage to disconnect the drive shaft from the linkage to allow the door to move to the open position without actuation of the motor;

wherein:

the linkage includes a first arm and a second arm spaced from the first arm;

the linkage includes a connector disposed between and connected to the first and second arms;

the connector of the linkage is secured to the door; and the back-up release assembly engages the first arm or the second arm when in an extended position to connect the drive shaft to the linkage.

17. The port-door release assembly as set forth in claim 16 wherein:

the back-up release assembly includes a sleeve attached to the drive shaft; and the sleeve and the first arm of the linkage each include a key that cooperate with each other when in the extended position to transfer rotational movement between the drive shaft and the linkage.

18. A door assembly comprising:

a housing defining a port;

a port-door release assembly coupled to the housing and including:

a door movable relative to the housing between an open position that uncovers the port and a closed position that covers the port;

a linkage coupled to the door to support the door during movement between the open position and the closed position;

a drive shaft rotatable about a longitudinal axis and coupled to the linkage to drive movement of the linkage;

a motor coupled to the drive shaft and configured to rotate the drive shaft to move the linkage and the door to the open position and/or the closed position; and a back-up release assembly coupled to the linkage and the drive shaft, and the back-up release assembly is movable relative to the linkage to disconnect the drive shaft from the linkage to allow the door to move to the open position without actuation of the motor.

19. The door assembly as set forth in claim 18 wherein:

the housing includes a first side that faces the door and a second side that opposes the first side;

the housing defines a plurality of slots spaced from each other, and the port is disposed between the slots;

the linkage includes a first arm disposed through one of the slots and a second arm disposed through another one of the slots; and the back-up release assembly engages the first arm or the second arm when in an extended position to connect the drive shaft to the linkage.

20. The door assembly as set forth in claim 19 wherein:

the back-up release assembly includes a sleeve attached to the drive shaft;

the sleeve engages the first arm when in the extended position and disengages from the first arm when in a retracted position to disconnect the drive shaft from the linkage to allow the door to move to the open position without actuation of the motor;

the back-up release assembly includes a pull rod disposed through the drive shaft and the sleeve; and the pull rod is movable along the longitudinal axis to cause the sleeve to move axially along the longitudinal axis independently of the drive shaft to disengage the sleeve from the linkage when in the retracted position.

* * * * *